US008044877B2

(12) United States Patent
Wang et al.

(10) Patent No.: US 8,044,877 B2
(45) Date of Patent: Oct. 25, 2011

(54) ANTENNA

(75) Inventors: Chao-Chun Wang, Tu-Cheng (TW); Hui-Ling Lan, Tu-Cheng (TW); Jung-Kun Hsieh, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 322 days.

(21) Appl. No.: 12/453,570

(22) Filed: May 15, 2009

(65) Prior Publication Data

US 2010/0289719 A1 Nov. 18, 2010

(51) Int. Cl.
*H01Q 1/36* (2006.01)

(52) U.S. Cl. ..... 343/895; 343/700 MS

(58) Field of Classification Search ..... 343/700 MS, 343/895

See application file for complete search history.

(56) References Cited

U.S. PATENT DOCUMENTS 5,870,066 A * 2/1999 Asakura et al. ..... 343/895
6,018,298 A * 1/2000 Endo et al. ..... 340/572.5
2008/0111742 A1 * 5/2008 Chao et al. ..... 343/700 MS

* cited by examiner

*Primary Examiner* — Dieu H Duong
(74) *Attorney, Agent, or Firm* — Rosenberg, Klein & Lee

(57) ABSTRACT

An antenna includes a substrate having a first layer, a second layer, a third layer and a fourth layer, and an antenna unit having a first pattern being of a substantially coiled shape and printed on the first layer, a second pattern being of a meandering shaped and printed on the second layer, a third pattern being of a meandering shaped and printed on a third layer, and a fourth pattern being of a substantially coiled shaped and printed on the fourth layer. The first pattern, the second pattern, the third pattern and the fourth pattern are of a serial connection. The free end of the first pattern connects a feeding point. The free end of the fourth pattern connects a grounding point. Thus, the antenna has advantages of compact size and low cost, due to the antenna unit printed on the substrate and the pattern of the antenna unit.

19 Claims, 3 Drawing Sheets

| | Frequency (MHZ) | VSWR |
|---|---|---|
| Mkr1 | 82 | 4.35 |
| Mkr2 | 92 | 4.03 |
| Mkr3 | 103 | 1.1 |
| Mkr4 | 110 | 3.93 |

ANTENNA

BACKGROUND OF THE INVENTION

1. Field of the Invention

The present invention relates to an antenna, more particularly, to an antenna with compact size and low cost.

2. The Related Art

The mobile phone has become one of essential apparatuses in daily lives nowadays. According to progress of the mobile and marketing request, there are various types of functions, such as taking a picture, playing music, recording voice, recording video, playing games, receiving broadcast, etc, embedded in the mobile phone. The functions mentioned above have become essential functions of the mobile phone.

For an instance of receiving broadcast, the mobile phone need an antenna for receiving broadcast signal and a means for processing the received broadcast signal. Because the broadcast bands cover the range from hundreds KHz to hundreds MHz, the length of the antenna capable of receiving broadcast signal needs to be from one meter to several meters.

Thus, the antenna capable of receiving broadcast signal has a certain size. Considering the compact size is a necessary element for the mobile phone, it is difficult to manufacture the antenna embedded in the mobile phone to be capable of receiving broadcast signal.

An embedded broadcast receiving antenna is disclosed at Taiwan patent M320194. The Taiwan patent discloses a FM antenna has a ceramic body and a microstrip conductor disposed on the ceramic body. The ceramic body is of a rectangle shape. The microstrip conductor is of a helix shape and winded on surfaces of the ceramic body.

The ceramic body in prior art is made of ceramic material with high dielectric constant for the purpose of shortening the length of the microstrip conductor. Thus, the FM antenna can be a small size and is likely to be well-configured in the mobile phone. However, the FM antenna has high cost due to the high cost of the ceramic material.

A further type of the FM antenna is shown from U.S. Pat. No. 7,064,720. The U.S. patent discloses an earphone antenna having an earphone unit including an earphone, an earphone cable for supplying audio signals to the earphone, and a first pin jack connector portion on one end of the earphone cable, the earphone cable functioning as an antenna wire.

Because the earphone cable functions as an antenna wire, the mobile phone must connect the earphone antenna for receiving FM signal from the earphone antenna and processing the FM signal. The earphone phone antenna has the following defects: It is inconvenient to carry the earphone antenna all the time. The size of the earphone antenna can hardly be reduced. Moreover, it takes more cost and longer repairing time.

SUMMARY OF THE INVENTION

The object of the present invention is to provide an antenna having a printed circuit board and an antenna unit. The printed circuit board has a top layer, a first inner layer disposed below the top layer, a second inner layer dispose below the first inner layer, a bottom layer disposed below the second inner layer, and at least three dielectric layers respectively disposed between the top layer and the first inner layer, the first inner layer and the second inner layer, and the second inner layer and the bottom layer.

The antenna unit has a first pattern being of a substantially coiled shape, a second pattern being of a meandering shape, a third pattern being of a meandering shape, a fourth pattern being of a substantially coiled shape, a first conducting through hole, a second conducting through hole, a third conducting through hole, a feeding point and a grounding point.

The first pattern, the second pattern, the third pattern and the fourth pattern are respectively printed on the top layer, the first inner layer, the second inner layer and the bottom layer. The feeding point is disposed on the top layer and connected to one end of the first pattern. The first conducting through hole penetrated the dielectric layer disposed between the top layer and the first inner layer and electronically interconnecting the other end of the first pattern and one end of the second pattern.

The second conducting through hole penetrated the dielectric layer disposed between the first inner layer and the second inner layer and electronically interconnecting the other end of the second pattern and one end of the third pattern. The third conducting through hole penetrated the dielectric layer disposed between the second inner layer and the bottom layer and electronically interconnecting the other end of the third pattern and one end of the fourth pattern. The grounding point disposed on the bottom layer and connected to the other end of the fourth pattern.

Because the antenna unit is printed on the printed circuit board, the cost of the antenna can be reduced. Because the first pattern and the fourth pattern are of a rectangular substantially coiled shape, and the second pattern and the third pattern are of a meandering shape corresponding to the shape of the first pattern and the fourth pattern, the size of the antenna can be reduced. Therefore, the antenna in the present invention has advantages of low cost and compact size.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Structures of the antenna described herein are compact and well-designed for operating at a broadcast band. In an embodiment of the invention described in detail below, the antenna has a structure for operating at FM broadcast band.

Figure 1:
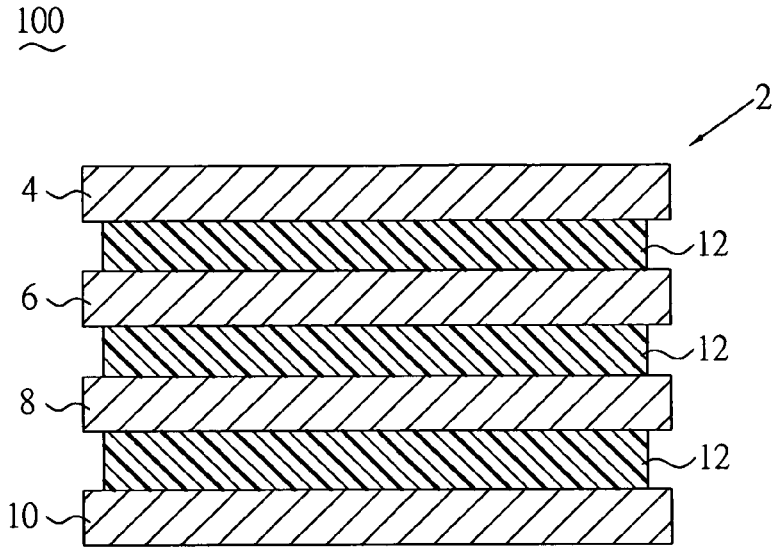
FIG. 1 is a cross-section view showing an antenna unit of an antenna printed on a four layers printed circuit board according to the present invention.
Figure 2:
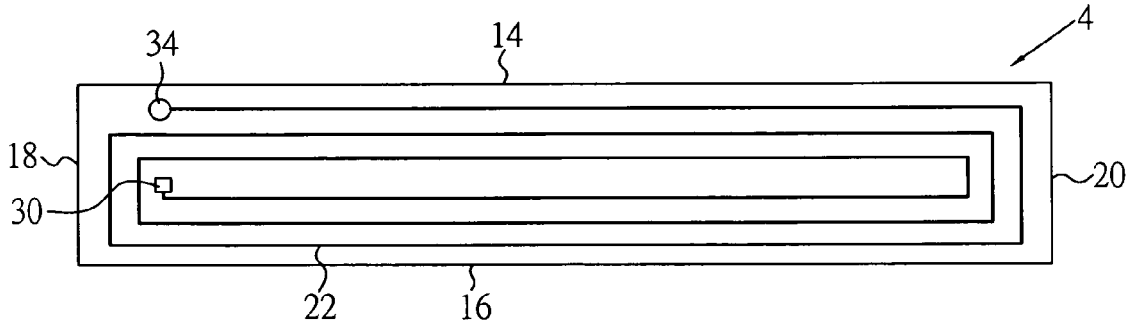
FIG. 2 shows a first conductor pattern of the antenna unit printed on a top layer of the printed circuit board according to the present invention.
Figure 3:
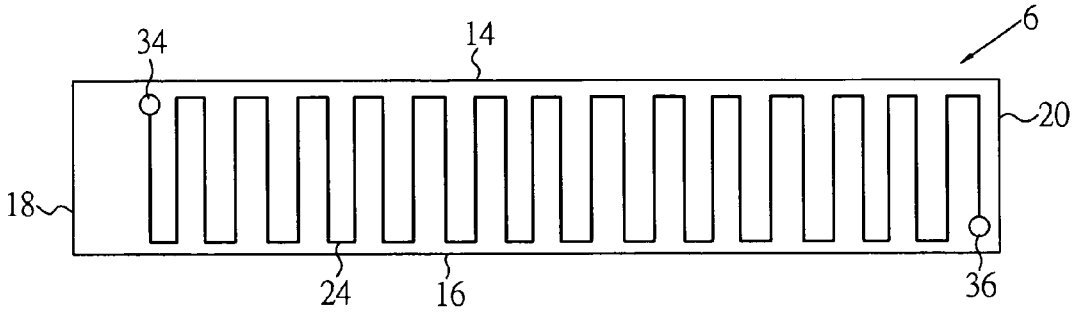
FIG. 3 shows a second conductor pattern of the antenna unit printed on a first inner layer of the printed circuit board according to the present invention.
Figure 4:
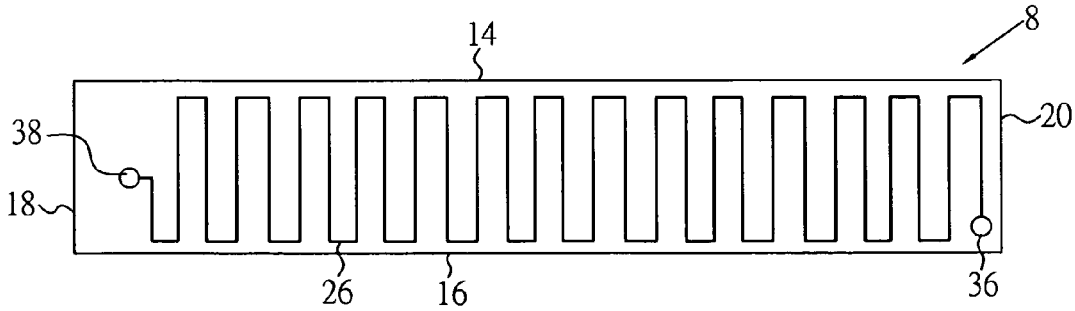
FIG. 4 shows a third conductor pattern of the antenna unit printed on a second inner layer of the printed circuit board according to the present invention.
Figure 5:
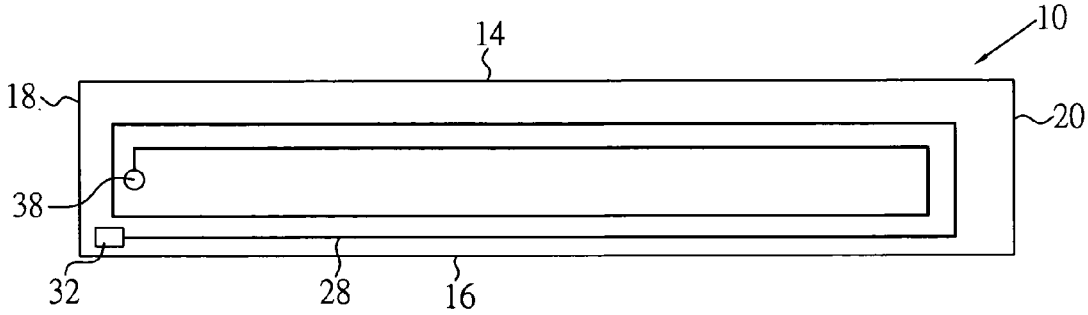
FIG. 5 shows a fourth conductor pattern of the antenna unit printed on a bottom layer of the printed circuit board according to the present invention.

Please refer to FIG. 1. A preferred embodiment of the antenna 100 according to the present invention is shown. The antenna 100 has a printed circuit board (PCB) 2 and an antenna unit printed on the PCB 2. The PCB 2 is a four layer PCB having a top layer 4, a first inner layer 6 disposed below the top layer 4, a second inner layer 8 disposed below the first inner layer 6, and a bottom layer 10 disposed below the second inner layer 8. In a further case, the printed circuit board 2 may be a flex printed circuit.

There are three dielectric layers 12 respectively disposed between the top layer 4, the first inner layer 6, the second inner layer 8 and the bottom layer 10. The PCB 2 is of a rectangular shape and defines a first side 14, a second side 16 opposite to the first side 14, a third side 18, and a fourth side 20 opposite to the third side 18. The third side 18 interconnects one end of the first side 14 and one end of the second side 16. The fourth side 20 interconnects the other end of the first side 14 and the other end of the second side 16.

Please refer to FIG. 2 to FIG. 5. The antenna unit comprises a first pattern 22, a second pattern 24, a third pattern 26, a fourth pattern 28, a feeding point 30, a ground point 32, a first conducting through hole 34, a second conducting through hole 36 and a third conducting through hole 38.

The first pattern 22 is printed on the top layer 4 of the PCB 2. The second pattern 24 is printed on the first inner layer 6 of the PCB 2. The third pattern 26 is printed on the second inner layer 8 of the PCB 2. The fourth pattern 28 is printed on the bottom layer 10 of the PCB 2.

The feeding point 30 is disposed on an inner portion of the top layer 4 and close to the third side 18. The first conducting through hole 34 is formed at the top layer 4 and close to a corner where the first side 14 connects the third side 18. The first conductor through hole 34 penetrates the dielectric layer 12 disposed between the top layer 4 and the first inner layer 6 and electronically connects the first pattern 22 and the second pattern 24.

Especially, the feeding point 30 is a pad. The inner surface of the first conducting through hole 34 is electroplated with an electrical conducting material such as a copper. The first pattern 22 is of a rectangular substantially coiled shape. One end of the first pattern 22 connects the feeding point 30 and the other end of the first pattern 22 connects the first conducting through hole 34.

Especially, the first pattern 22 is extended from the feeding point 30, toward the second side 16, and repeatedly and orderly bent toward the fourth side 20, the first side 14, the third side 18 and the second side 16, and then connected to the first conducting through hole 34.

The second conducting through hole 36 is formed at a corner where the second side 16 connects to the fourth side 20. The second conductor through hole 36 penetrates the dielectric layer 12 disposed between the first inner layer 6 and the second inner layer 8 and electronically connects the second pattern 24 and the third pattern 26. The inner surface of the second conducting through hole 36 is electroplated with electrical conducting material such as copper.

The second pattern 24 is of a meandering shape. One end of the second pattern 24 connects the first conducting through hole 34 and the other end of the second pattern 24 connects the second conducting through hole 36.

Especially, the second pattern 24 is extended from the first conducting through hole 34, toward the second side 16, and repeatedly and orderly bent toward the fourth side 20, the first side 14, the fourth side 20 and the second side 16, and then connected to the second conducting through hole 36.

The third conducting through hole 38 is formed at a center area of the second inner layer 8 and close to the third side 18. The third conductor through hole 38 penetrates the dielectric layer 12 disposed between the second inner layer 8 and the bottom layer 10 and electronically connects the third pattern 26 and the fourth pattern 28. The inner surface of the third conducting through hole 38 is electroplated with electrical material such as copper.

The third pattern 26 is of a meandering shape. One end of the third pattern 26 connects to the second conducting through hole 36 and the other end of the third pattern 26 connects to the third conducting through hole 38.

Especially, the third pattern 26 is extended from the second conducting through hole 36, toward the first side 14, and repeatedly and orderly bent toward the third side 18, the second side 16, the third side 18 and the first side 14, and then connected to the third conducting through hole 38.

The grounding point 32 is a pad and disposed on a corner where the second side 16 connects to the third side 18. The fourth pattern 28 is of a rectangular substantially coiled shape. One end of the fourth pattern 28 connects to the third conducting through hole 38 and the other end of the fourth pattern 28 connects to the grounding point 32.

Especially, the fourth pattern 28 is extended from the third conducting through hole 38, and repeatedly and orderly toward the fourth side 20, the second side 16, the third side 18 and the first side 14, and then connected to the ground point 32. Thus, the antenna unit functions as a loop antenna.

Figure 6:
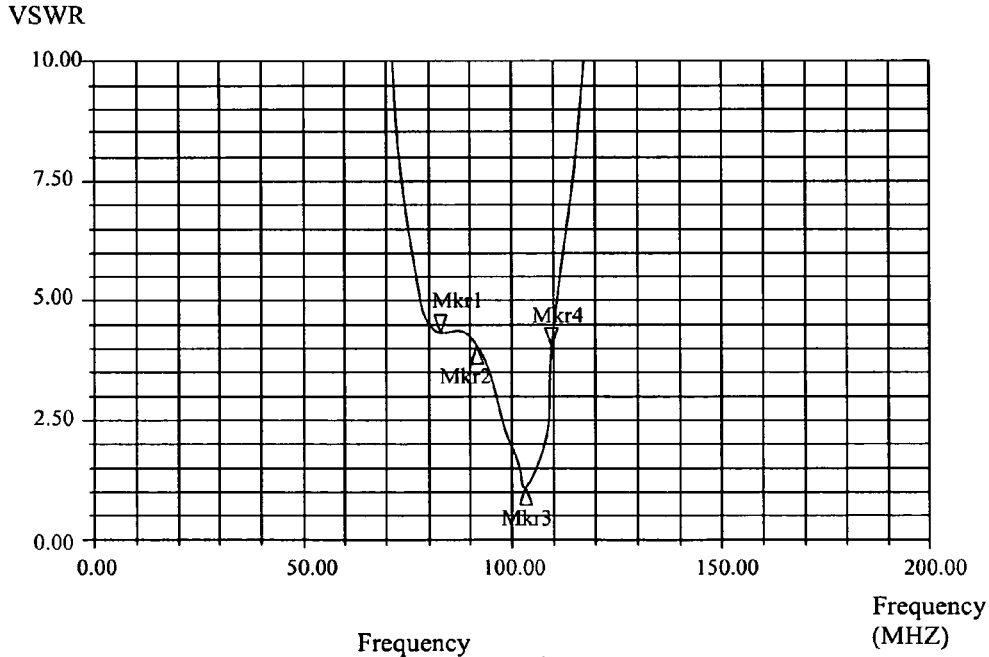
FIG. 6 shows a Voltage Standing Wave Ratio (VSWR) test chart of the antenna.

Please refer to FIG. 6, it shows a Voltage Standing Wave Ratio (VSWR) test chart of the antenna 100. If the antenna 100 operates at 82 MHz, then the VSWR value is 4.35. If the antenna 100 operates at 92 MHz, then the VSWR value is 4.03. If the antenna 100 operates at 103 MHz, then the VSWR value is 1.1. If the antenna 100 operates at 110 MHz, then the VSWR value is 3.93.

As described above, the first pattern 22, the second pattern 24, the third pattern 26 and the fourth pattern 28 are respectively printed on the top layer 4, the first inner layer 6, the second inner layer 8 and the bottom layer 10. The first conducting through hole 34, the second conducting through hole 36 and the third conducting through hole 38 respectively interconnects the first pattern 22 and the second pattern 24, the second pattern 24 and the third pattern 26, and the third pattern 26 and the fourth pattern 28.

Thus, the cost of the antenna 100 can be reduced. The first pattern 22 and the fourth pattern 28 are of a rectangular substantially coiled shape, and the second pattern 24 and the third pattern 26 are of a meandering shape. Thus the size of the antenna 100 can be reduced. The antenna 100 has the advantages of low cost and compact size.

Furthermore, the present invention is not limited to the embodiments described above; various additions, alterations and the like may be made within the scope of the present invention by a person skilled in the art. For example, respective embodiments may be appropriately combined.

What is claimed is:

1. An antenna, comprising:

a printed circuit board comprising:

a plurality of layers including a top layer, a first inner layer disposed below the top layer, a second inner layer disposed below the first inner layer, a bottom layer disposed below the second inner layer; and a plurality of dielectric layers each disposed between two of the adjacent of the plurality of the layers;

an antenna unit comprising:

a first pattern printed on the top layer and being of a substantially coiled shape;

a second pattern printed on the first inner layer and being of a meandering shape;

a third pattern printed on the second inner layer and being of a meandering shape;

a fourth pattern printed on the bottom layer and being of a substantially coiled shape;

a feeding point disposed on the top layer and connected to one end of the first pattern;

a first conducting through hole penetrated the dielectric layer disposed between the top layer and the first inner layer, and electronically interconnecting the other end of the first pattern and one end of the second pattern;

a second conducting through hole penetrated the dielectric layer disposed between the first inner layer and the second inner layer, and electronically interconnecting the other end of the second pattern and one end of the third pattern;

a third conducting through hole penetrated the dielectric layer disposed between the second inner layer and the bottom layer, and electronically interconnecting the other end of the third pattern and one end of the fourth pattern; and a grounding point disposed on the bottom layer and connected to the other end of the fourth pattern.

2. The antenna as claimed in claim 1, wherein the printed circuit board defines a first side, a second side opposite to the first side, a third side and a fourth side opposite to the third side, the feeding point is disposed on a center area and close to the third side, the first conducting through hole is formed to close to a corner where the first side connects to the third side, the second conducting through hole is formed to close to a corner where the second side connects to the fourth side, the third conducting through hole is formed at a center area and close to the third side, the grounding point is disposed to close to a corner where the second side connects to the third side.

3. The antenna as claimed in claim 2, wherein the first pattern is of a rectangular coiled shape, the first pattern is extended from the feeding point, toward the second side, and repeatedly and orderly bent toward the fourth side, the first side, the third side and the second side, and then connected to the first conducting through hole.

4. The antenna as claimed in claim 2, wherein the second pattern is extended from the first conducting through hole, toward the second side, and repeatedly and orderly bent toward the fourth side, the first side, the fourth side and the second side, and then connected to the second conducting through hole.

5. The antenna as claimed in claim 2, wherein the third pattern is extended from the second conducting through hole, toward the first side, and repeatedly and orderly bent toward the third side, the second side, the third side and the first side, and then connected to the third conducting through hole.

6. The antenna as claimed in claim 2, wherein the fourth pattern is extended from the third conducting through hole, and repeatedly and orderly toward the fourth side, the second side, the third side and the first side, and then connected to the ground point.

7. The antenna as claimed in claim 2, wherein the printed circuit board is of a rectangular shape.

8. The antenna as claimed in claim 1, wherein the feeding point and the grounding point are pads.

9. The antenna as claimed in claim 1, wherein the inner surfaces of the first conducting through hole, the second conducting through hole and the third conducting through hole are electroplated with electrical material.

10. An antenna, comprising:

a substrate comprising a first layer, a second layer disposed below the first layer, a third layer disposed below the second layer, a fourth layer disposed below the third layer, a first dielectric layer disposed between the first layer and the second layer, a second dielectric layer disposed between the second layer and the third layer and a third dielectric layer disposed between the third layer and fourth layer;

a first conducting pattern being of a substantially coiled shape and printed on the first layer;

a second conducting pattern being of a meandering shape and printed on the first inner layer;

a third conducting pattern being of a meandering shape and printed on the second inner layer;

a fourth conducting pattern being of a substantially coiled shape and printed on the bottom layer;

a feeding point connected to one end of the first conducting pattern;

a first conducting through hole penetrated the first dielectric layer and electronically interconnecting the other end of the first conducting pattern and one end of the second conducting pattern;

a second conducting through hole penetrated the second dielectric layer and electronically interconnecting the other end of the second conducting pattern and one end of the third conducting pattern;

a third conducting through hole penetrated the third dielectric layer and electronically interconnecting the other end of the third conducting pattern and one end of the fourth conducting pattern; and a grounding point connected to the other end of the fourth conducting pattern.

11. The antenna as claimed in claim 10, wherein the substrate is one of a printed circuit board and a flex printed circuit.

12. The antenna as claimed in claim 10, wherein the feeing point is a pad disposed on the first layer, the grounding point is a pad disposed on the fourth layer.

13. The antenna as claimed in claim 10, wherein the substrate defines a first side, a second side opposite to the first side, a third side and a fourth side opposite to the third side, the feeding point is arranged at a center area and close to the third side, the first conducting through hole is formed to close to a corner where the first side connects to the third side, the second conducting through hole is formed to close to a corner where the second side connects to the fourth side, the third conducting through hole is formed at a center area and close to the third side, the grounding point is disposed to close to a corner where the second side connects to the third side.

14. The antenna as claimed in claim 13, wherein the first conducting pattern is of a substantially rectangular coiled shape, the first conducting pattern is extended from the feeding point, toward the second side, and repeatedly and orderly bent toward the fourth side, the first side, the third side and the second side, and then connected to the first conducting through hole.

15. The antenna as claimed in claim 13, wherein the second conducting pattern is extended from the first conducting through hole, toward the second side, and repeatedly and orderly bent toward the fourth side, the first side, the fourth side and the second side, and then connected to the second conducting through hole.

16. The antenna as claimed in claim 13, wherein the third conducting pattern is extended from the second conducting through hole, toward the first side, and repeatedly and orderly bent toward the third side, the second side, the third side and the first side, and then connected to the third conducting through hole.

17. The antenna as claimed in claim 13, wherein the fourth conducting pattern is extended from the third conducting through hole, and repeatedly and orderly toward the fourth side, the second side, the third side and the first side, and then connected to the ground point.

18. The antenna as claimed in claim 13, wherein the printed circuit board is of a rectangular shape.

19. The antenna as claimed in claim 10, wherein the inner surfaces of the first conducting through hole, the second conducting through hole and the third conducting through hole are electroplated with electrical material.

* * * * *